US006237375B1

(12) United States Patent
Wymer

(10) Patent No.: US 6,237,375 B1
(45) Date of Patent: May 29, 2001

(54) LAP TOP LOCK

(76) Inventor: William E. Wymer, 233 Lincoln Ave., West Berlin, NJ (US) 08091

( * ) Notice: Subject to any disclaimer, the term of this patent is extended or adjusted under 35 U.S.C. 154(b) by 0 days.

(21) Appl. No.: 09/458,679

(22) Filed: Dec. 10, 1999

(51) Int. Cl.[7] ..... E05B 73/00

(52) U.S. Cl. ..... 70/14; 70/18; 70/19; 70/58; 248/551

(58) Field of Search ..... 70/18, 19, 58, 70/14, 57, 163, 164; 312/223.2; 248/551, 552, 553

(56) References Cited

U.S. PATENT DOCUMENTS

| | | | | |
|---|---|---|---|---|
| Re. 35,677 | * | 12/1997 | O'Neill | 70/58 X |
| 3,410,122 | * | 11/1968 | Moses | 70/58 |
| 4,028,913 | * | 6/1977 | Falk | 70/58 |
| 5,052,199 | * | 10/1991 | Derman | 70/58 |
| 5,052,651 | * | 10/1991 | Guddee | 248/553 X |
| 5,351,508 | * | 10/1994 | Kelley | 70/58 |
| 5,406,809 | * | 4/1995 | Igelmund | 70/58 X |
| 5,447,045 | * | 9/1995 | Cheng | 70/58 |
| 5,595,074 | | 1/1997 | Munro | 70/58 |
| 5,642,634 | * | 7/1997 | Perry | 70/58 X |
| 5,645,261 | * | 7/1997 | Glynn | 70/58 X |
| 5,709,110 | | 1/1998 | Greenfield et al. | 70/58 |
| 5,757,616 | | 5/1998 | May et al. | 70/58 X |
| 5,787,738 | | 8/1998 | Brandt et al. | 70/58 |
| 6,092,401 | * | 7/2000 | Sankey et al. | 70/18 |
| 6,125,669 | * | 10/2000 | McDaid et al. | 70/58 |
| 6,138,483 | * | 10/2000 | Galant | 70/58 |

FOREIGN PATENT DOCUMENTS

| | | | | |
|---|---|---|---|---|
| 509840 | * | 2/1955 | (CA) | 70/18 |
| 1558956 | * | 1/1969 | (FR) | 70/18 |

* cited by examiner

*Primary Examiner*—Lloyd A. Gall
(74) *Attorney, Agent, or Firm*—Patent & Trademark Services; Joseph H. McGlynn

(57) ABSTRACT

A lap top security device which has two adjustable arms and two fixed arms which engage with a lock and which adjust to fit different size computers to lock the computer closed. In addition one of the fixed arms has a loop so the security device can be attached to a fixed object.

7 Claims, 1 Drawing Sheet

LAP TOP LOCK

BACKGROUND OF THE INVENTION

This invention relates, in general, to security devices, and, in particular, to a security device for a lap top computer

DESCRIPTION OF THE PRIOR ART

In the prior art various types of security devices have been proposed. For example, U.S. Pat. No. 5,757,616 to May et al discloses a locking bar for locking a display and system unit together. The device also prevents removal of peripheral devices and disables input from the keyboard and mouse.

U.S. Pat. No. 5,709,110 to Greenfield et al discloses a lap top security system comprising mounting plate affixed to the monitor housing and a cable which attaches to a table or counter top.

U.S. Pat. No. 5,787,738 to Brandt et al discloses a security lock for a computer comprising a blade which passes through the gap between the monitor and keyboard and which is fastened to a fixed object.

U.S. Pat. No. 5,595,074 to Munro discloses a desktop security locking station comprising a box and a clamping mechanism for securing the box to the computer. The box is then secured to a table top.

SUMMARY OF THE INVENTION

The present invention is directed to a lap top security device which has two adjustable arms and two fixed arms which engage with a lock and which adjust to fit different size computers to lock the computer closed. In addition one of the fixed arms has a loop so the security device can be attached to a fixed object.

It is an object of the present invention to provide a new and improved computer security device.

It is an object of the present invention to provide a new and improved computer security device which will secure a lap top computer in a closed position.

It is an object of the present invention to provide a new and improved computer security device which has provisions to secure the security device to a fixed object.

These and other objects and advantages of the present invention will be fully apparent from the following description, when taken in connection with the annexed drawings.

DESCRIPTION OF THE PREFERRED EMBODIMENT

Figure 1:
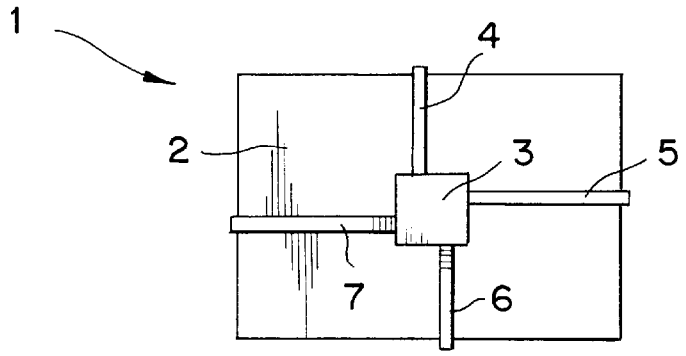
FIG. 1 is a top view of the present invention attached to a lap top computer.
Figure 3:
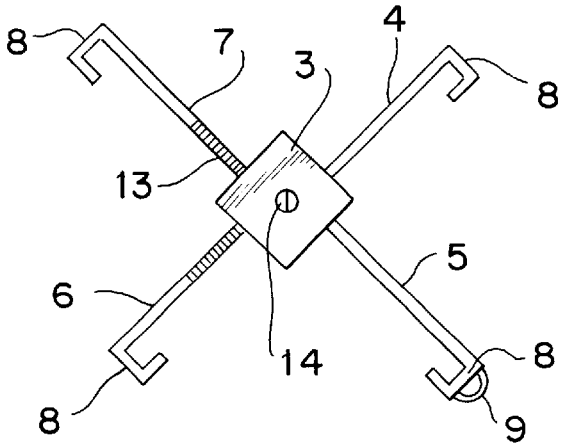
FIG. 3 is a top view of the locking device of the present invention.

Referring now to the drawings in greater detail, FIG. 1 shows the locking device 1 of the present invention as it would be attached to a lap top computer, as seen from the top 2 of the computer. The locking device, as more clearly seen in FIG. 3, comprises four arms 4, 5, 6, 7 which slide into a lock casing 3 and are lockingly retained therein. It should be noted that the arms 4, 5, 6, 7 as shown in FIG. 3 are turned 90° from their operating position for clarity.

As seen in FIG. 1, the arm 4 is offset slightly from the arm 6, which is directly opposite arm 4. Likewise, arm 5 is offset slightly from the arm 7 which is directly opposite arm 5, in order to prevent any interference between the arms as they enter the lock casing 3. Also, arms 4 and 6 will be offset slightly from the arms 5 and 7 for the same reason.

The lock casing 3 is a conventional lock having a top, bottom and a plurality of sides with the arms extending from the sides which has projections inside which will engage the grooves 13 on the arms 4, 5, 6, 7 and hold the arms within the casing 3, therefore, no further description of the lock casing is necessary. The lock casing can have an aperture 14 to receive a key for unlocking the arms 4, 5, 6, 7 so they can be disengaged from the casing 3. It should be noted that it is not critical that the key hole 14 be on the top of the lock casing in order to work. It could also be placed on one of the sides of the lock casing 3.

Figure 2:
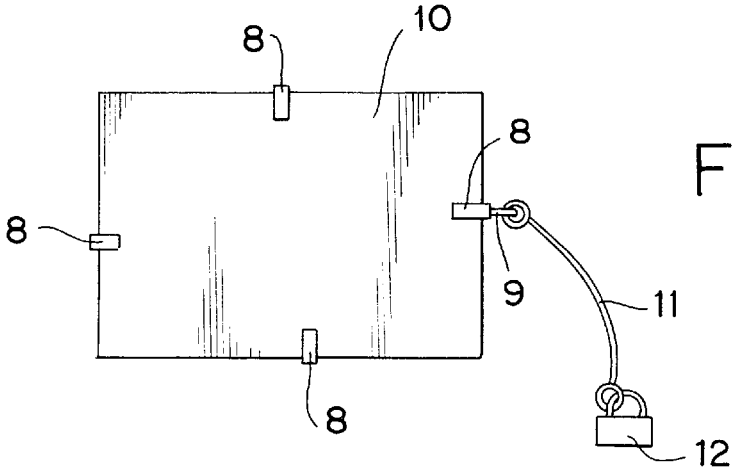
FIG. 2 is a bottom view of the present invention attached to a lap top computer.

As shown in FIGS. 1 and 2, when the lap top computer is closed, the security device of the present invention can be secured to the closed lap top by positioning the arms 4, 5, 6, 7 as shown and sliding the arms into the lock casing 3 where they will be secured against removal. The hook portions 8 of the arms will engage beneath the lap top, and will prevent any one, without a key from opening the lap top. Therefore, even if a thief takes the lap top they will be unable to open and use it. This will make it undesirable for someone to take the lap top. Also, securing the lap top in this manner will prevent anyone from accessing any information stored on the lap top.

As shown in FIGS. 2 and 3, at least one of the arms has a loop 9 attached thereto. As shown in FIG. 2, this loop, along with a cable 11 and a lock 12 can be used to secure the lap top 2, 3 to a fixed object, such as a desk, by looping the cable around a portion of the desk and securing it by means of the lock 12. This will increase the security of the lap top.

Although the Lap Top Lock and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A security device for a lap top computer, said security device comprising:

a lock casing having a top, bottom and a plurality of sides, at least four arm means for engaging said lock casing being linearly slidable relative to said lock casing, and being secured thereto, each of said arm means having securing means attached thereto for engaging sides of said lap top computer, whereby when said arm means are secured to said lap top computer and secured to said lock casing, said arm means will prevent said lap top computer from being opened.

2. The security device for a lap top computer as claimed in claim 1, wherein said securing means attached to each of said arm means for engaging sides of said lap top computer is a hook.

3. The security device for a lap top computer as claimed in claim 1, wherein said arm means have a plurality of groove means for engaging said lock casing and securing said arm means within said lock casing.

4. The security device for a lap top computer as claimed in claim 1, wherein at least one of said arm means has means for locking said at least one of said arm means to a fixed object.

5. The security device for a lap top computer as claimed in claim 4, wherein said means for locking said at least one of said arm means to a fixed object is a cable and a second lock casing.

6. The security device for a lap top computer as claimed in claim 4, wherein said at least one of said arm means has a loop secured thereto for receiving said means for locking said at least one of said arm means to a fixed object.

7. The security device for a lap top computer as claimed in claim 6, wherein said at least one of said arm means has a loop secured thereto and a cable is attached to said loop.

* * * * *